US005101213A

United States Patent [19]

Harada et al.

[11] Patent Number: 5,101,213

[45] Date of Patent: Mar. 31, 1992

[54] SCREW TYPE COUPLING DEVICE AND AN ANTENNA INSTALLATION DEVICE USING THE SAME

[75] Inventors: Jiro Harada, Tokyo; Heizo Tsuchida, Kanagawa, both of Japan

[73] Assignee: Harada Kogyo Kabushiki Kaisha, Tokyo, Japan

[21] Appl. No.: 440,593

[22] Filed: Nov. 22, 1989

[30] Foreign Application Priority Data

Jan. 23, 1989 [JP] Japan ..... 1-6212
Jan. 25, 1989 [JP] Japan ..... 1-6525

[51] Int. Cl.[5] ..... H01Q 1/320; H01Q 1/200

[52] U.S. Cl. ..... 343/715; 343/888; 343/900; 403/229; 403/343; 411/366; 411/411; 411/438

[58] Field of Search ..... 343/713, 715, 904, 900, 343/906, 702, 888; 403/229, 343; 411/16, 17, 392, 438, 411, 424, 425, 366; 439/801, 805, 840, 916

[56] References Cited

U.S. PATENT DOCUMENTS 556,082 3/1896 Boeddinghaus ..... 411/438
809,880 1/1906 Woolldridge et al. ..... 411/392
1,861,532 6/1932 Hough ..... 403/229
3,243,755 3/1966 Johnston ..... 411/392
4,914,450 4/1990 Dilley et al. ..... 439/916

FOREIGN PATENT DOCUMENTS 1074302 10/1954 France ..... 343/900
0021065 of 1894 United Kingdom ..... 411/438

*Primary Examiner*—Rolf Hille
*Assistant Examiner*—Peter Toby Brown
*Attorney, Agent, or Firm*—Koda and Androlia

[57] ABSTRACT

A screw type coupling device includidng a male screw element formed by installing a coil spring form helical component on the outer surface of a columnar element and a female screw element formed by installing a coil spring form helical component in a tubular element so that the two helical components are screw engaged with each other. With the application of such coupling device to an antenna for vehicles, the antenna having the male screw element at the base is removably attached to a vehicle body by screwing the male screw element of the antenna to the female screw element installed in the vehicle body.

5 Claims, 7 Drawing Sheets

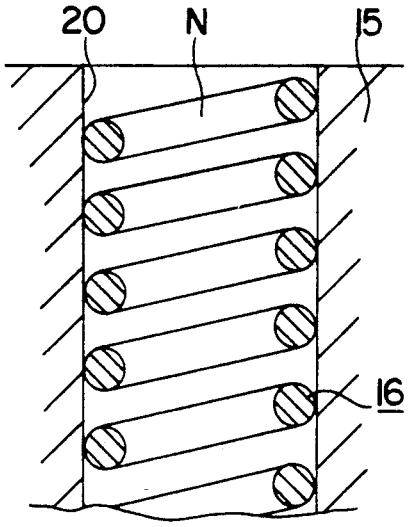
FIG.12
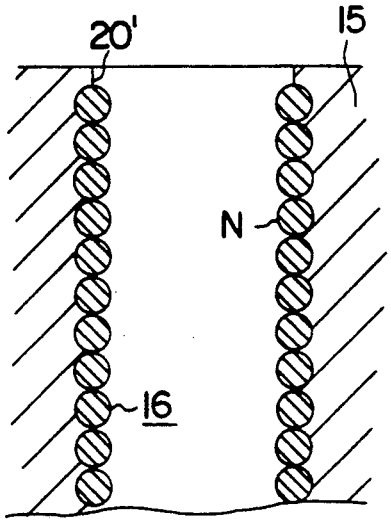
FIG.13
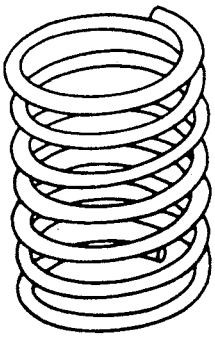
FIG.15
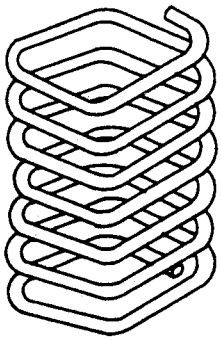
FIG.16
FIG.17(a)
FIG.17(b)
FIG.17(c)

SCREW TYPE COUPLING DEVICE AND AN ANTENNA INSTALLATION DEVICE USING THE SAME

BACKGROUND OF THE INVENTION

1. Field of the Invention

The present invention relates to a device for coupling two elements by means of screw engagement of male and female elements and to an antenna installation device which utilizes such a coupling device.

2. Prior Art

FIG. 18 is a cross sectional view of a conventional antenna installation device removably fastening the lower end of a rod-form automobile antenna to the upper end of an attachment base installed in a vehicle body.

A rod-form automobile antenna element 1 (whip antenna element) is provided with a joint 2 at the lower end. The joint 2 has a first screw element M provided integrally which has a male threaded part 3 formed on its outer surface by cutting or thread rolling. A beveled area 4 is formed on the external surface of the joint 2 so as to facilitate the screwing in or unscrewing of the antenna 1.

An attachment base 5 is made of an insulating material and is mounted on the vehicle body wall. A female screw element N, formed by cutting a female threaded part 6 (which can engage with the male threaded part 3) along the axis of a conductive part 7, is provided at the center of the attachment base 5. The end portion of a terminal rod 8 which is used for connecting an antenna feeder line is inserted into the lower end of the conductive part 7.

In this type of antenna installation device, the antenna element 1 is removably attached to the vehicle body wall by screwing the male screw element M of the joint 2 of the antenna element 1 into the female screw element N of the attachment base 5 in the direction indicated by the arrow in FIG. 18.

However, this type of antenna attachment device has some disadvantages. The male threaded part 3 of the male screw element M and the female threaded part 6 of the female screw element N are both formed by cutting or thread rolling using a tool such as a die or tap, etc. Thus, a considerable amount of work is required, and the cost becomes proportionally higher. Furthermore, unless finishing precision is very high, rattling, etc., tends to occur, and it becomes very difficult to maintain stable coupling. In addition, loosening tends to occur as a result of vibration, etc., during operation of the automobile. Accordingly, unless some device (e.g., a spring washer, etc.) is used to prevent such loosening, there is a danger that the coupled parts may separate and the antenna element 1 will fall out. Thus, the structure becomes more complex if a device for preventing loosening is added, resulting in that the installation is more complex.

Another type of antenna is also on the market, and this type of antenna provides a single-length whip antenna which is manufactured at low cost while providing excellent radio reception (which is a minimum requirement for such antennas). This antenna consists of a single conductive rod which is more or less matched to a quarter (¼) wavelength of the FM wave band. When installed, the antenna is exposed outside of the vehicle. Thus, high tensile strength materials having a high recoil strength (e.g., high tensile strength stainless steel, etc.) are used so that the antennas can withstand loads which may be applied by obstructions while the vehicle is in motion and during washing.

When this type of whip antenna is mounted on a vehicle body in an assembly line, it occupies a large amount of dead space in the transport trucks used for transporting such vehicles. For this reason, the whip antenna is usually designed to be removable via screw coupling, etc., to an attachment base on the vehicle body.

This type of antenna, however, also has problems. Since it uses a material of high tensile strength, it has poor workability, and thread cutting is difficult. As a result, it is difficult to screw couple the antenna to the attachment base "as is". Accordingly, the antenna employs the structure as shown in FIG. 19. The joint 2 is fixed to the base end of the whip antenna element 1, and the male screw 3 attached to this joint 2 is screwed into the female screw 6 installed in the coupling part 5 of the attachment base 4. The joint 2 is made of a material which has a tensile strength lower than the whip antenna element 1 in order to insure good workability, and when this material is used it must be thoroughly tested in view of its strength. Accordingly, there is a limit in terms of manufacturing costs.

Another problem is that even if material of proven strength is used, screw coupling must be accomplished in a restricted space so that the dimensions of the male screw cannot be very large. As a result, if the load resulting from bending of the whip antenna element 1 in the direction indicated by the arrow in FIG. 19 is concentrated in the screw area, the root of the male screw 3 is likely to bend or break.

SUMMARY OF THE INVENTION

Accordingly, a first object of the present invention is to provide a screw type coupling device which makes it possible to form a male screw element and a female screw element of any desired size (in terms of thread dimensions, pitch, etc.) in a simple manner without any need for cutting, thus allowing the coupling device to be manufactured at a low cost.

A second object of the present invention is to provide a screw type coupling device which provides a tight screw-connection, which is free of rattling, even where there is a slight dimensional error or variation, etc. in the helical pitch, etc. of the respective helical components, thus making it possible to obtain an effect that is equivalent to the effect obtained by high-precision screw finishing.

A third object of the present invention is to provide a screw type coupling device in which there is no danger of any loosening of the screw-connected parts even though no special device to prevent such loosening is installed, so that even if the coupling device is subjected to vibrations, etc., there in no danger that the device will become unscrewed and thus allow one of the coupled parts to separate from the other and fall out.

A fourth object of the present invention is to provide an antenna installation device equipped with a coupling device wherein a male screw element and a female screw element of the coupling device can be formed without performing cutting work thereto, so that the coupling device can be manufactured at a low cost, has a simple structure, and provides a stable coupling force.

In order to achieve the first object of the present invention, (a) a male screw element is formed by installing a coil spring form helical component on the outer circumference of a columnar base, (b) a female screw element is formed by installing a coil spring form helical component (which is capable of screw engagement with the helical component of the male screw element) on the inner circumference of a tubular base, so that a screw type coupling device is obtained from the male screw element and the female screw element.

In order to achieve the second object of the present invention, the helical component of the male screw element and the helical component of the female screw element described above are installed so that at least ore end of each helical component is fixed to the base for the corresponding screw element, with the other end of the helical components remaining unfixed.

In order to achieve the third object of the present invention, (a) the dimensions of the respective parts are set so that when the male screw element is screwed into the female screw element, the outer-circumferential portions of the helical component of the male screw element are pressed against the inner-circumferential portions of the helical component of the female screw element, and (b) the inner circumferential surface of the tubular base of the female screw element is formed from a flexible material.

In order to achieve the fourth object of the present invention, the screw type coupling device is interposed between the lower end of a rod-form automobile antenna element and the upper end of an attachment base (which is mounted on the vehicle body wall) as a coupling means so that the lower end of the antenna element is coupled to the upper end of the attachment base, allowing the antenna to be removed.

With the above described structure, the present invention provides the following effects:

The male screw element and female screw element can be formed by helical components with prescribed wire diameters. Consequently, these screw elements can be simply and easily formed without any need for laborious cutting. Thus, the screw type coupling device of this invention can be manufactured at a low cost.

Elastic deformation is generated between the respective helical component when the two helical components are screwed together as the screwing of the male screw element and female screw element progresses. Accordingly, strain-absorbing action is generated in the parts settling in against each other. As a result, a tight screw connection which is free of rattling can be obtained even if some slight dimensional errors or variations, etc., exist in the helical pitch, etc., of the respective helical components. Thus, the same effect as with high precision screw finishing can be obtained.

Predetermined pressing forces act more positively in the area of the screw connection. Since expansion deformation of the helical component of the female screw element is forced, the diameter thereof increases, and the female screw element is pressed against the inner circumferential surface of the tubular base part. Especially when the inner circumferential surface of the tubular base is formed from a flexible material, the female screw element may even bite into the inner circumferential surface. Thus, even if no special device is provided to prevent loosening, etc., loosening will not occur, and even if the device is subjected to vibrations, there is no danger that the coupled parts will come unscrewed and fall out.

The antenna mounting device of the present invention utilizes the above described coupling device in which the male and female screw elements thereof are formed without cutting work. As a result, the coupling device can be manufactured at a low cost, has a simple structure, and provides stable coupling.

BRIEF DESCRIPTION OF THE DRAWINGS

FIGS. 12, 13 and 14 show the female screw elements of different embodiments of the present invention;

FIGS. 15 and 16 show coil spring form helical components employed in the present invention;

FIGS. 17(*a*), 17(*b*) and 17(*c*) show cross sections of the helical components employed in the present invention.

DETAILED DESCRIPTION OF THE INVENTION

Figure 1:
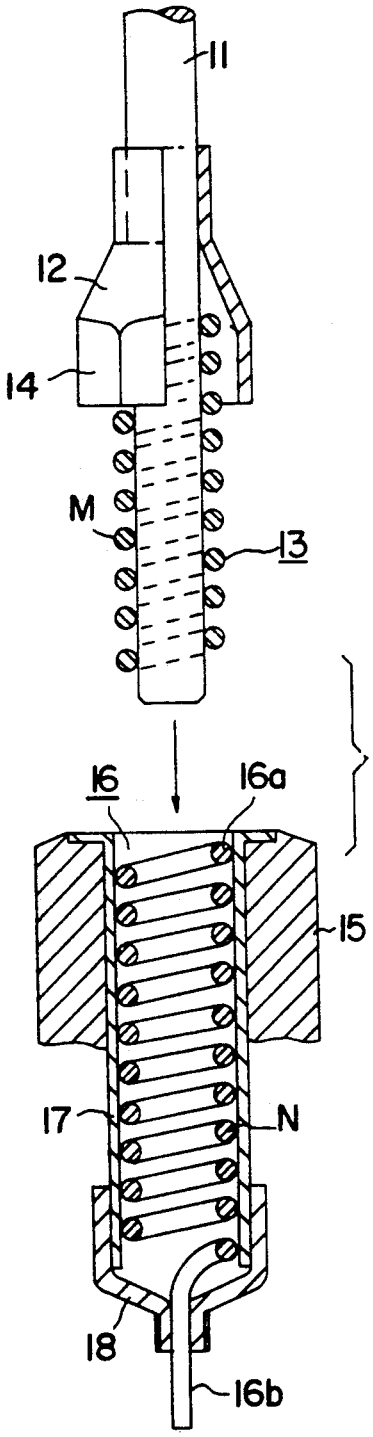
FIG. 1 is a cross sectional view of the structure of a first embodiment of the present invention.

FIG. 1 shows a cross section of the structure of one embodiment of the present invention, where the invention is applied to an automobile antenna mounting assembly.

The antenna mounting assembly is designed so that the lower end of a rod-form automobile antenna element 11 is removably attached to the upper end of an attachment base 15 (which has been fastened to the vehicle body wall beforehand). The antenna element 11 has an antenna installation cap 12 near the lower end. A male screw element M is provided on the circumference of the (shank portion of the) antenna element 11 at a position below the antenna installation cap 12.

The male screw element M is formed as follows: A first helical component 13 is formed by coiling a stainless steel wire, for example, with a prescribed wire diameter into the shape of a coil spring. The thus formed helical component 13 is mounted around the outer circumferential surface of the lower end area of the antenna element 11 which acts as a columnar base part. One end of the helical component 13 is fixed to the: antenna element 11 by welding, etc.

A hexagonal surface 14 is formed on the outer surface of the antenna installation cap 12 in order to facilitate screwing in and unscrewing of the antenna element 11 using a tool such as a spanner, etc.

The attachment base 15 is made of an insulating material and has been fixed on the vehicle body wall beforehand. A female screw element N is provided in this attachment base 15. The female screw element N is formed basically as in the same manner as the male screw element M. Specifically, a second helical component 16 is formed by coiling a stainless steel wire material, for instance, with the same wire diameter and pitch as the first helical component 13, into the shape of a coil spring and is installed in a fastening cylinder 17 which acts as a tubular base. The upper end portion 16*a* of the second helical component 16 is fixed to the inner circumferential surface of the fastening cylinder 17 so that the helical component 16 does not rotate, and the remainder of the helical component 16 is more or less free to move. The lower end of the fastening cylinder 17 is covered by an end closure 18. A hole is formed in the center of the end closure 18, and the lower end 16*b* of the helical component 16 is led out through this hole. Thus, the lower end 16*b* is able to function as a terminal rod for connecting an antenna feeder line thereto.

Figure 2:
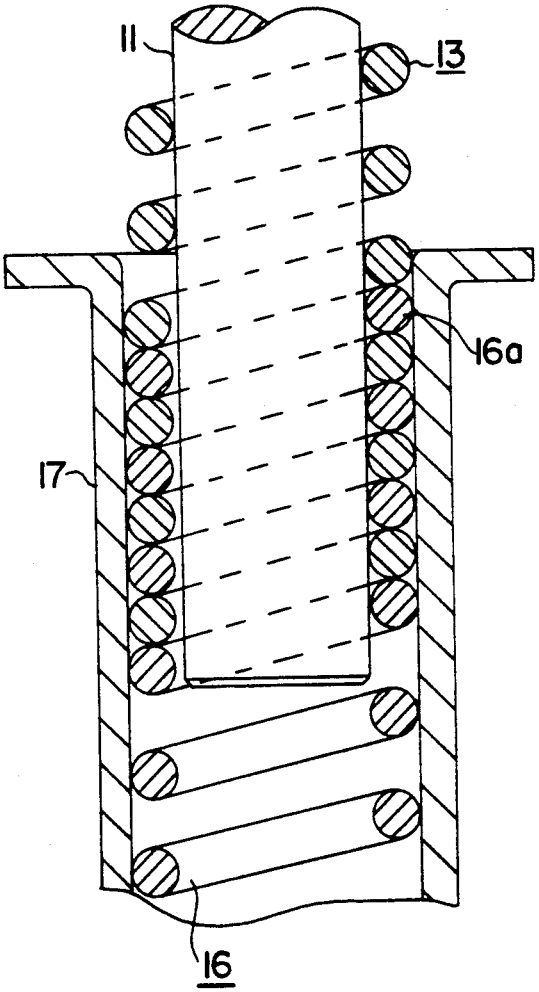
FIG. 2 is an enlarged cross sectional view showing the connection of two screw elements used in the embodiment of FIG. 1.

When the rod-form automobile antenna element 11 is attached to the vehicle body wall, the male screw element M is screwed into the female screw element N installer in the attachment base 15 in the direction shown by the arrow in FIG. 1. As a result, the first helical component 13 of the male screw element M is tightly screwed into the second helical component 16 of the female screw element N as shown in FIG. 2.

In this case, since only one end 16*a* of the helical component 16 is fixed to the fastening cylinder 17 (which acts as a base part) so that the remaining portion thereof is more or less free to move, elastic deformation is generated between the two helical components 13 and 16 as they are screwed together. Thus, the helical components 13 and 16 settle in against each other. As a result of this mutual settling, strain which would occur between the respective helical components can be absorbed and eliminated. Hence, even if there is a slight dimensional error or variation, etc. in the helical pitch, etc. of the helical components 13 and 16, the two components can be tightly screwed together without causing any rattling. Thus, an effect which is equivalent to the effect obtained by high-precision screw finishing can be obtained.

When the rod-form automobile antenna element 11 is removed from the vehicle body wall, the male screw element M installed on the lower end of the antenna element 11 is unscrewed from the female screw element N by pulling the male screw element M (or antenna element 11) in a direction opposite to the arrow in FIG. 1. As a result, the first helical component 13 of the male screw element M is unscrewed from the second helical component 16 of the female screw element N.

Thus, as described above, the rod-form automobile antenna element 11 can easily be mounted to and removed from the vehicle body.

In the above embodiment, the male screw element M and female screw element N are formed by respective helical components 13 and 16. In other words, the screw elements M and N can be formed easily without any need for the laborious cutting, etc., required in conventional devices. Accordingly, such a screw type coupling device which consists of the male screw element M and female screw element N can be manufactured at a low cost. Furthermore, the wire diameters of the helical components 13 and 16 can be set at any desired size regardless of the diameter or wall thickness, etc. of the antenna element 11 and the fastening cylinder 17. Accordingly, even if the diameter or wall thickness, etc., of the antenna element 11 is too small to form thread thereon, such a requirement can easily be satisfied by selecting the wire diameter of the helical components 13 and 16 in accordance with the magnitude of the mechanical coupling force that is required.

Figure 3:
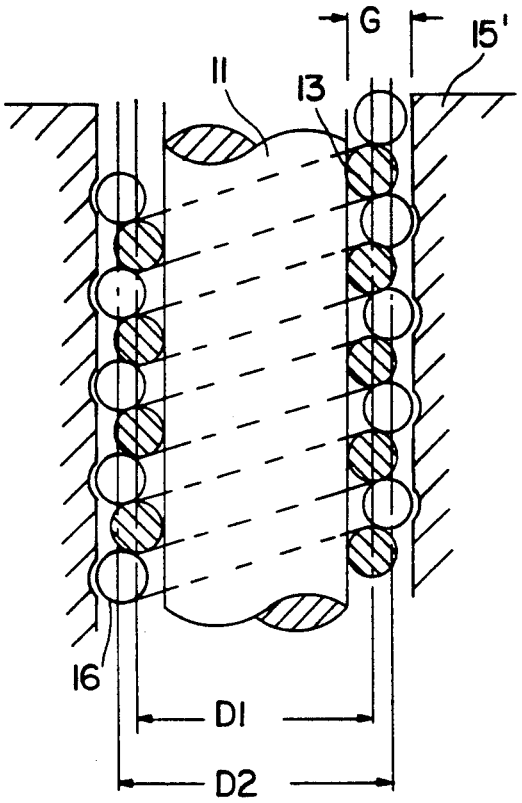
FIG. 3 is a cross sectional view showing the relationship of two screw elements of another embodiment of the present invention.

FIG. 3 shows a cross section of a second embodiment of the present invention. This embodiment differs from the first embodiment in the following two respects: First, the dimensions of the two screwing parts are set so that when the male screw element M is screwed into the female screw element N, the outer circumferential portions of the first helical component 13 of the male screw element M are pressed against the inner circumferential portions of the second helical component 16 of the female screw element N. Second, the inner circumferential surface of the attachment base 15' for the female screw element N is formed from a flexible material, e.g., a soft synthetic resin, etc. Accordingly, when the two helical components 13 and 16 are screwed together, they press against each other in a radial direction with the respective helical diameters D1 and D2 maintaining the relationship of:

$$D1 < D2.$$

As shown in FIG. 3, the helical diameters D1 and D2 are substantially constant along the length of the helical components.

In this case, the size of the gap G is set as described below in order to insure that the pressing force between the facing surfaces acts reliably.

Figure 4:
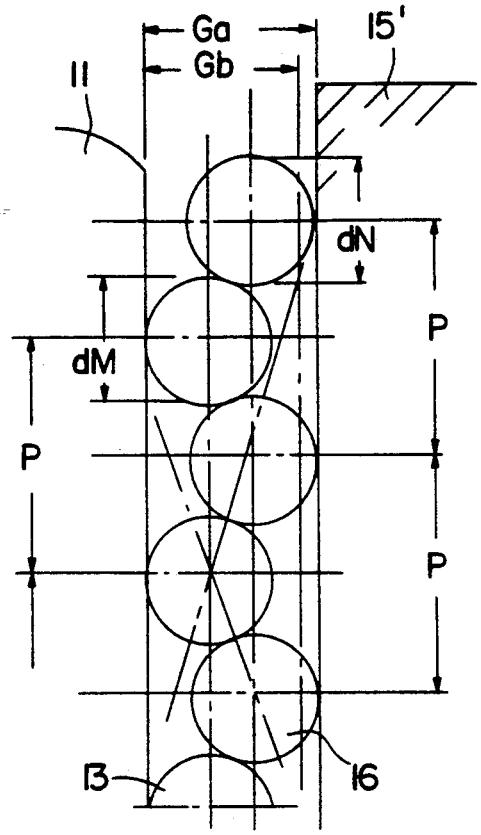
FIG. 4 illustrates the dimensional conditions for the screw elements of FIG. 3.

FIG. 4 shows the dimensions that are required in order for the helical components 13 and 16 to have the relationship shown in FIG. 3.

First, the pitch P of the first helical component 13 and the pitch P of the second helical component 16 must coincide in order for the two helical components 13 and 16 to overlap so that the two are shifted relative to each other in the radial direction.

Next, it is necessary to satisfy the relationship below, in which dM is the wire diameter of the first helical component 13 and dN is the wire diameter of the second helical component 16:

$$dM + dN > P > dM \text{ (or } dN)$$

Referring to "dM (or dN)" in the above formula, the larger of the two wire diameters is selected. If dM equals dN, then the inequality becomes:

$$2dM\ (=2dN) > P > dM \text{ (or } dN)$$

Furthermore, the gap G between the outside circumferential surface of the antenna element 11 (which acts as the columnar base part) and the inside circumferential surface of the attachment base 15' is set at Gb which is slightly smaller than Ga (which is geometrically determined when the pitch P is set at a prescribed size in accordance with the wire diameters as described above). As a result, a prescribed pressing force is obtained more positively in the screw connection area when the helical components 13 and 16 are screwed together. Furthermore, the helical component 16 is subjected to an expansion deformation in a direction which increases the helical diameter of the helical component 16. As a result, the helical component 16 bites into the circumferential surface of the attachment base 15' which consists of a flexible material.

Thus, this embodiment has the same effect as the first embodiment. In addition, in this embodiment, there is no danger that the coupled elements will loosen even though no special device for preventing the loosening, etc. is installed. Thus, even if the antenna is subjected to vibration, etc., during operation of the automobile, the coupled elements will not come unscrewed and the antenna element 11 will not fall out.

Figure 5:
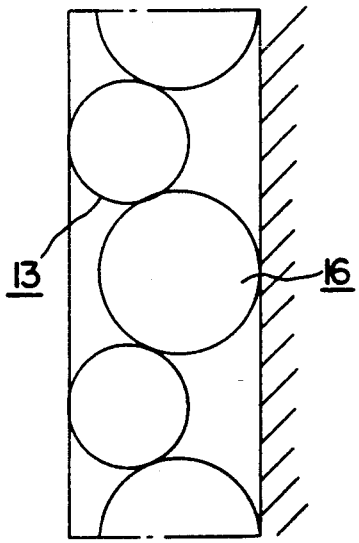
FIG. 5 shows a schematic view of the relationship of two screw elements of another embodiment of the present invention.

In the above embodiments, the wire diameter of the first helical component 13 and the wire diameter of the second helical component 16 are equal; however they can be different. For example, as shown in FIG. 5, the wire diameter of the first helical component 13 can be smaller than the wire diameter of the second helical component 16 so that the two helical components are shifted relative to each other in a radial direction and overlap as in the embodiment of FIG. 2.

Figure 6:
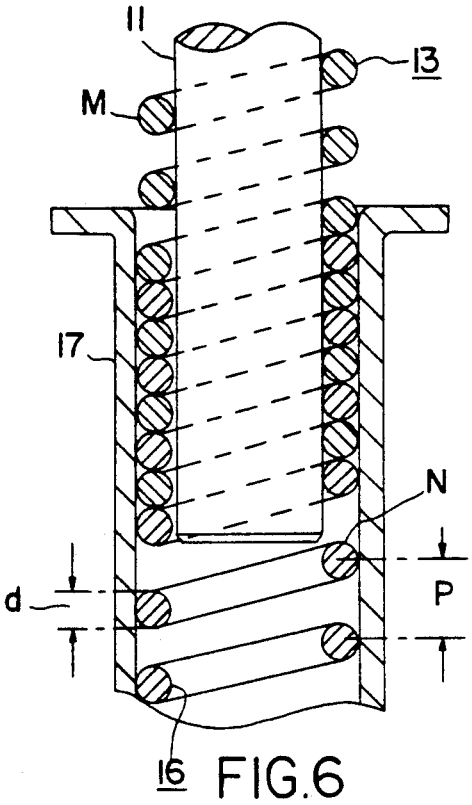
FIGS. 6, 7 and 8 illustrate the relationship of two screw elements of different embodiments of the present invention.
Figure 7:
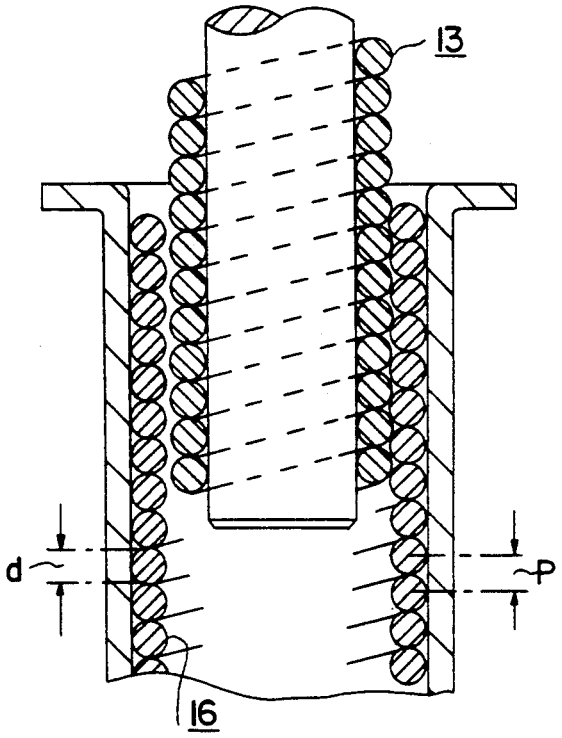

Furthermore, in the above embodiment, &the helical pitch P of each of the first and second helical components 13 and 16 is approximately twice as large as the wire diameter d of such helical components ($P \approx 2d$) as shown in FIG. 6. However, it is possible to set the helical pitch P of these two helical components 13 and 16 to be about the same as the wire diameter d of these helical components ($P \approx d$) as shown in FIG. 7. In this case, the male screw element M is screw-connected to the female screw element N so that the male screw element M is inside the female screw element N by P/2.

Figure 8:
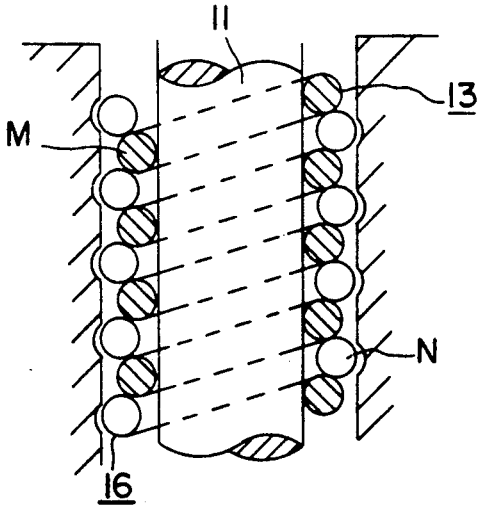

Furthermore, as shown in FIG. 8, it is also possible to screw-couple the first helical component 13 with the second helical component 16 with a dimensional relationship that is intermediate between FIGS. 6 and 7.

Figure 9:
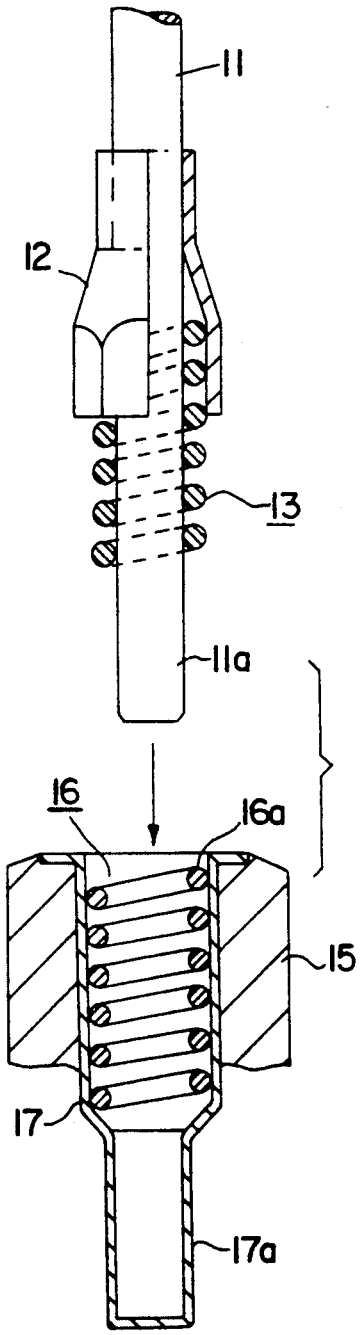
FIG. 9 shows a screw connection employed in another embodiment of the present invention.

FIG. 9 shows a modified connection between the antenna 11 and the attachment base 15. In this antenna, the first helical component 13 is provided away from the lower end of the antenna element 11, and the lower end 11*a* of the antenna element 11 (i.e., the portion not covered by the first helical component 13) is supported by being tightly inserted into a narrow-diameter part 17*a* located at the lower end of the fastening cylinder 17 in the attachment base 15.

With this structure, since the male screw element M is formed by installing a coil spring form helical component 13 on the outer circumferential surface of the lower end portion of the antenna element 11, a highly rigid and highly elastic whip element material can be used "as is" as a coupling core. Thus, a force which is able to withstand bending stress generated by external forces can be obtained from the whip antenna element itself. As a result, the coupling strength is stronger than a conventional joint, and no bending or breaking would occur even if a large load is applied. Also, since the upper portion of the helical component 13 is positioned inside the antenna installation cap 12, the space inside the cap 12 is filled by the helical component 13, thus reinforcing the antenna installation cap 12.

Figure 10:
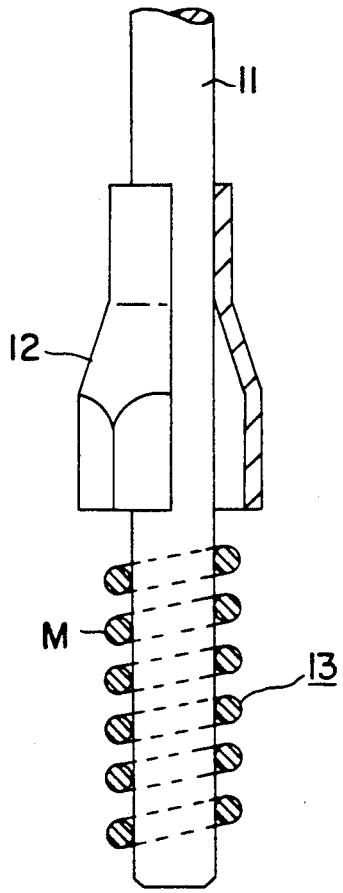
FIGS. 10 and 11 show different type of antenna installation caps employed in the present invention.
Figure 11:
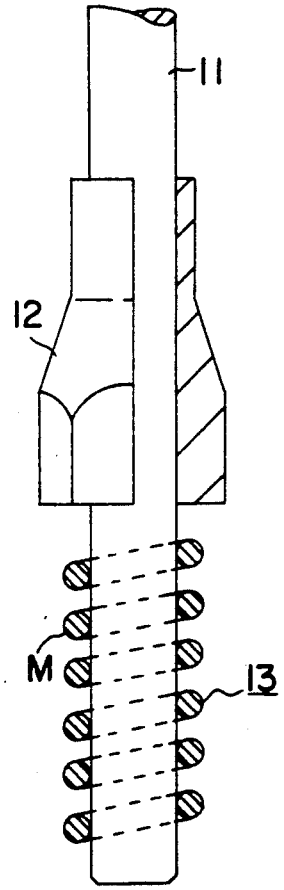
Figure 18:
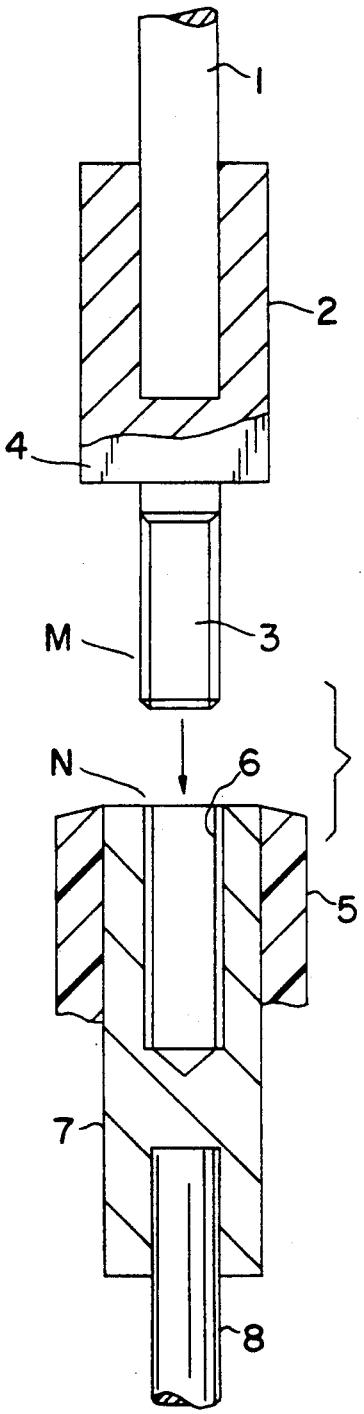
FIG.18 PRIOR ART
FIGS. 18 and 19 show prior art antenna installation devices.
Figure 19:
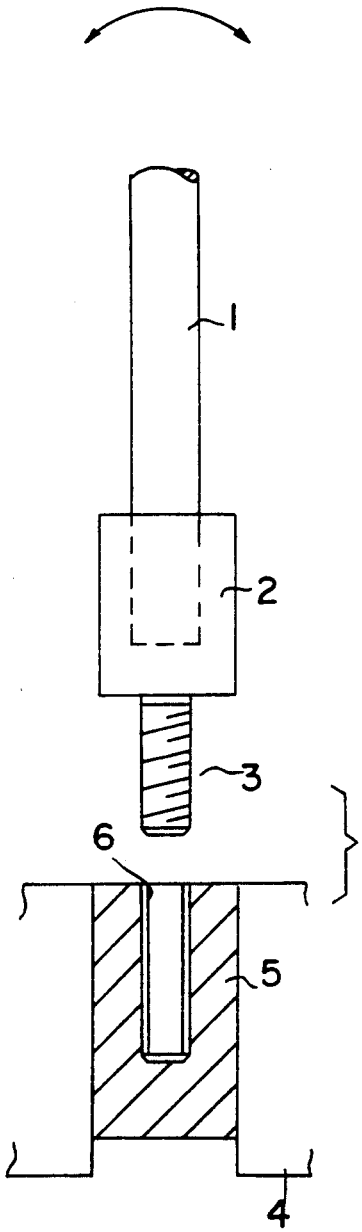
FIG.19 PRIOR ART

In all of the above described embodiments, an upper end portion of the helical component 13 is positioned inside the antenna installation cap 12 so that the cap 12 is reinforced. However, if there is no need for such reinforcement, the helical component 13 can be installed as shown in FIG. 10 so that the helical component 13 is not covered by the skirt portion of the installation cap 12. It is also possible to use an installation cap 12' which does not have an internal space as shown in FIG. 11.

In the above described embodiments, the antenna installation cap 12 is in a skirt-like shape. However, it may have any shape which allows the use of a tightening tool.

Figure 14:
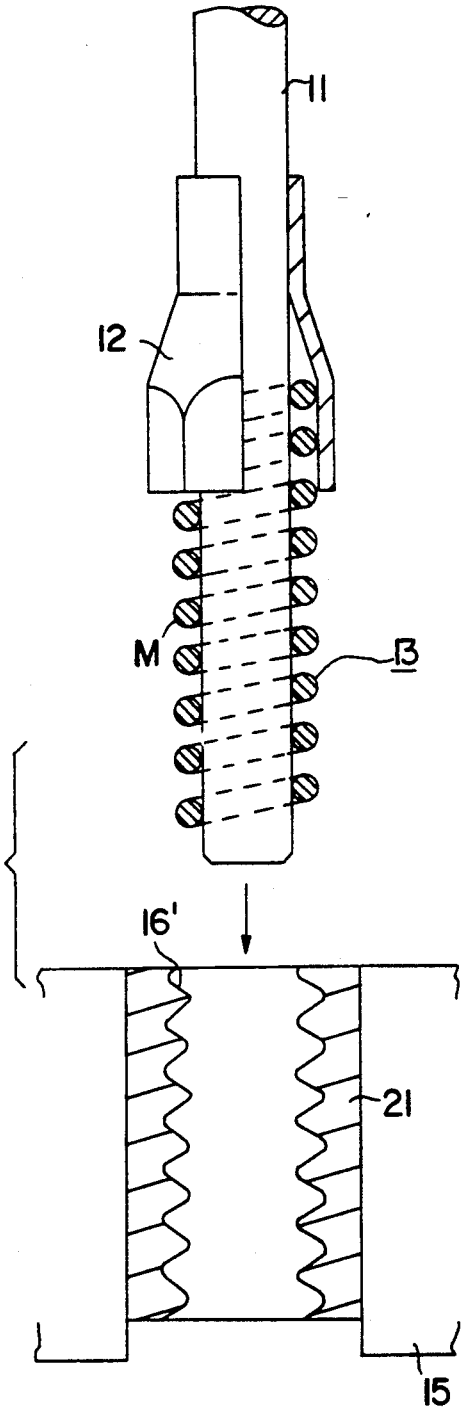

Though the fastening cylinder 17 is used for coupling the male and female screw elements M and N in the above described embodiments, a hole 20 can be made directly in the attachment base 15 as shown in FIG. 12. It would also the possible to mold the attachment base 15 from a material such as synthetic resin, etc. so that it tightly surrounds the circumference of the coiled helical component 16 as shown in FIG. 13, thus forming an attachment hole 20' having partially embedded helical component 16 therein. Furthermore, as shown in FIG. 14, the male screw element M of the antenna 11 can be screwed into an ordinary female screw 16' of a connecting assembly 2I which is fixed in the attachment base 15.

In all of the embodiments, the invention is explained with reference to the helical component as shown in FIG. 15, which is a round shape component. However, it would be possible to use a square shaped helical component such as that shown in FIG. 16.

Furthermore, a wire with a square cross section as shown in FIG. 17(*b*) or a wire with an elliptical cross section as shown in FIG. 17(*c*) can be used for the helical components instead of a wire with a circular cross section such as that shown in FIG. 17(*a*).

As described in detail, according to the present invention:

1. Since the male screw element and female screw element can be made without cutting, the coupling device can be manufactured at a low cost.

2. Since a tight screw connection which is free of rattling can be obtained even if there is a slight dimensional error or variation, etc., in the helical pitch, etc., of the respective helical component, the present invention can provide the same type of screw coupling device as high-precision couplings.

3. With the screw type coupling device of the present invention, there is no danger of the screw connection loosening even in the absence of anti-loosening devices. Accordingly, even though the device is subjected to vibrations, etc., there is no danger that the coupled elements will come unscrewed and one of them will separate from the other and thus fall out.

4. The antenna installation device is made up of a coupling device in which a male screw element and female scew element are formed without cutting work. As a result, the antenna installation device can be manufactured at low cost, has a simple structure, and provides stable coupling.

5. The male screw element is formed by installing a coil spring form helical component on the outside circumferential surface of the lower end portion of a rod-form antenna element so that the antenna element can e screw connected to an attachment base of a vehicle body. Thus, a whip antenna for vehicles in which the coupling portion of the antenna has a strength large enough to not break even if the load applied to the antenna is concentrated to the coupling portion.

6. The female screw element is formed by installing a coil spring form helical component in the attachment hole of an attachment base of a vehicle body so that an antenna having at its lower end a coil spring form helical component (and even a conventional antenna with a connecting screw formed at its base) is removably screwed connected to the female screw element. Thus, the antenna is easily mounted to the vehicle body with the two helical components being snugly and tightly connected to each other.

We claim:

1. An antenna installation device for removably attaching an antenna element to an attachment base installed in a vehicle body comprising:

a male screw element comprising a helical spring provided on an outer circumferential surface of a lower end of a columnar portion of said antenna; and a female screw element comprising a helical spring provided in a hole of said attachment bas so that said male screw element is screw connected to said female screw element.

2. A coupling device comprising screw elements engageable with each other, at least one of said screw elements being a coil spring form helical component, said screw elements comprising:

a male screw element consisting of a first helical component provided on an outer circumference of a columnar element with one end of said first helical component fixed to said columnar element; and a female screw element consisting of a second helical component provided in a fastening cylinder with one end of said second helical component fixed to said fastening cylinder, a diameter of a wire used for said second helical component being larger than a diameter of a wire used for said first helical component.

3. An antenna fastening device comprising:

an antenna element provided with a male screw element at its lower end, said male screw element consists of a first helical component with its upper end thereof fixed to said antenna element; and an antenna attachment base provided with a female screw element which engages with said male screw element, said female screw element consisting of a second helical component with its upper end fixed to said antenna attachment base, wherein at least one of said male and female screw elements is a coil spring helical component and at least one of said male and female screw elements has a constant helical diameter along its length.

4. An antenna fastening device according to claim 3, wherein helical diameters of said first and second helical components are equal.

5. An antenna fastening device comprising:

an antenna element provided with a male screw element at its lower end, said male screw element consists of a first helical component; and an antenna attachment base provided with a female screw element which engages with said male screw element, said female screw element consists of a second helical component, a diameter of a wire used for said second helical component being larger than a diameter of a wire used for said first helical component.

* * * * *